US011189416B2

(12) United States Patent
Nakatsuji et al.

(10) Patent No.: US 11,189,416 B2
(45) Date of Patent: Nov. 30, 2021

(54) COIL COMPONENT AND METHOD OF CHANGING FREQUENCY CHARACTERISTIC THEREOF

(71) Applicant: Murata Manufacturing Co., Ltd., Kyoto (JP)

(72) Inventors: Yoichi Nakatsuji, Nagaokakyo (JP); Kosuke Ishida, Nagaokakyo (JP); Ryo Okura, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 613 days.

(21) Appl. No.: 15/982,991

(22) Filed: May 17, 2018

(65) Prior Publication Data

US 2018/0350506 A1 Dec. 6, 2018

(30) Foreign Application Priority Data

Jun. 5, 2017 (JP) ..... JP2017-110966

(51) Int. Cl.
*H01F 27/29* (2006.01)
*H01F 27/28* (2006.01)
(Continued)

(52) U.S. Cl.
CPC ..... *H01F 27/2804* (2013.01); *H01F 17/0013* (2013.01); *H01F 17/04* (2013.01);
(Continued)

(58) Field of Classification Search
CPC ..... H01F 27/2804; H01F 2017/0093; H01F 27/324; H01F 27/29; H01F 27/24
(Continued)

(56) References Cited

U.S. PATENT DOCUMENTS 4,752,680 A * 6/1988 Larsson ..... G06K 19/0672 235/492
5,392,019 A * 2/1995 Ohkubo ..... H01F 27/36 336/200
(Continued)

FOREIGN PATENT DOCUMENTS

JP S63-015619 A 1/1988
JP H06-061058 A 3/1994
(Continued)

OTHER PUBLICATIONS

An Office Action; "Notification of Reasons for Refusal," Mailed by the Japanese Patent Office dated Aug. 27, 2019, which corresponds to Japanese Patent Application No. 2017-110966 and is related to U.S. Appl. No. 15/982,991; with English language translation.
(Continued)

*Primary Examiner* — Alexander Talpalatski
*Assistant Examiner* — Joselito Baisa
(74) *Attorney, Agent, or Firm* — Studebaker & Brackett PC

(57) ABSTRACT

A coil component comprising a coil conductor layer wound on a plane, an outer-circumferential lead-out conductor led out on the same plane as the coil conductor layer from an outer-circumferential end of the coil conductor layer, and an inner-circumferential lead-out conductor led out on the same plane as the coil conductor layer from an inner-circumferential end of the coil conductor layer. The coil component further comprises a branch conductor disposed to branch from at least one of the outer-circumferential lead-out conductor and the inner-circumferential lead-out conductor, and extending on the same plane as the coil conductor layer.

17 Claims, 14 Drawing Sheets

(51) Int. Cl.

| | |
|---|---|
| ***H01F 27/24*** | (2006.01) |
| ***H01F 27/32*** | (2006.01) |
| ***H01F 17/00*** | (2006.01) |
| ***H01F 17/04*** | (2006.01) |
| *H01F 41/04* | (2006.01) |
| *H01F 19/04* | (2006.01) |

(52) U.S. Cl.
CPC ..... *H01F 27/24* (2013.01); *H01F 27/29* (2013.01); *H01F 27/292* (2013.01); *H01F 27/323* (2013.01); *H01F 19/04* (2013.01); *H01F 41/045* (2013.01); *H01F 2017/0093* (2013.01); *H01F 2027/2809* (2013.01)

(58) Field of Classification Search
USPC ..... 336/192, 200
See application file for complete search history.

(56) References Cited

U.S. PATENT DOCUMENTS

| | | | | | |
|---|---|---|---|---|---|
| 5,583,474 | A * | 12/1996 | Mizoguchi | H01F 17/0006 | 336/83 |
| 6,005,467 | A * | 12/1999 | Abramov | H01F 17/0033 | 336/200 |
| 6,073,339 | A * | 6/2000 | Levin | H01F 17/0013 | 29/602.1 |
| 6,154,137 | A * | 11/2000 | Goff | H01Q 7/00 | 340/572.4 |
| 6,164,551 | A * | 12/2000 | Altwasser | G01V 15/00 | 235/383 |
| 6,618,929 | B2 * | 9/2003 | Kitamura | H01F 17/0013 | 29/602.1 |
| 7,453,343 | B2 * | 11/2008 | Ito | H01F 17/0013 | 336/200 |
| 8,093,996 | B2 * | 1/2012 | Heurtier | G06K 19/07749 | 340/407.2 |
| 8,749,338 | B2 * | 6/2014 | Takahashi | H01F 41/041 | 336/200 |
| 9,236,171 | B2 * | 1/2016 | Ito | H01F 5/003 | |
| 9,299,586 | B1 * | 3/2016 | West | H01L 21/32 | |
| 9,362,043 | B2 * | 6/2016 | Kido | H01F 41/042 | |
| 9,390,603 | B2 * | 7/2016 | Li | G06K 19/07786 | |
| 10,176,918 | B2 * | 1/2019 | Ishida | H01F 27/292 | |
| 2011/0002075 | A1 * | 1/2011 | Asakawa | H03H 7/0107 | 361/111 |
| 2013/0176096 | A1 * | 7/2013 | Takahashi | H01F 17/0013 | 336/200 |
| 2014/0266547 | A1 | 9/2014 | Watanabe et al. | | |
| 2015/0102891 | A1 * | 4/2015 | Yoon | H01F 27/2804 | 336/200 |

FOREIGN PATENT DOCUMENTS

| | | | |
|---|---|---|---|
| JP | H08-124745 | A | 5/1996 |
| JP | H11-243017 | A | 9/1999 |
| JP | 2002203720 | A | 7/2002 |
| JP | 2002271111 | A | 9/2002 |
| JP | 2008-277695 | A | 11/2008 |
| JP | 2009253233 | A | 10/2009 |
| JP | 2010040882 | A | 2/2010 |
| JP | 2012-038887 | A | 2/2012 |
| JP | 2014179453 | A | 9/2014 |
| JP | 2015-133523 | A | 7/2015 |
| JP | 2016-063229 | A | 4/2016 |

OTHER PUBLICATIONS

An Office Action; "Notification of Reasons for Refusal," Mailed by the Japanese Patent Office dated Jan. 14, 2020, which corresponds to Japanese Patent Application No. 2017-110966 and is related to U.S. Appl. No. 15/982,991; with English language translation.

* cited by examiner

COIL COMPONENT AND METHOD OF CHANGING FREQUENCY CHARACTERISTIC THEREOF

CROSS REFERENCE TO RELATED APPLICATION

This application claims benefit of priority to Japanese Patent Application 2017-110966, filed Jun. 5, 2017, the entire content of which is incorporated herein by reference.

BACKGROUND

Technical Field

The present disclosure relates to a coil component and a method of changing a frequency characteristic thereof.

Background Art

A conventional coil component is described in Japanese Laid-Open Patent Publication No. 2015-133523. This coil component has a spiral first coil conductor layer and a spiral second coil conductor layer laminated on the first coil conductor layer via an insulating layer.

SUMMARY

When changing or adjusting the characteristic of the conventional coil component as described above, the coil component is changed in overall structure such as the number of turns, the line width, the distance between lines, and the winding shape of the first and second coil conductor layers. For example, a common mode choke coil preferably has no difference in structure between the first and second coil conductor layers as far as possible and requires considerable effort and cost for design change since both the first and second coil conductor layers must basically be changed at the time of the design change. Moreover, a change in the overall structure causes changes in not only the characteristic desired to be changed or adjusted but also other characteristics, and therefore results in additional works such as trial production of multiple shapes and matching of characteristics.

Therefore, the present disclosure provides a coil component in which a characteristic of frequency of the coil component can easily be changed or adjusted, and a method of changing the frequency characteristic thereof.

A coil component of an aspect of the present disclosure comprises a coil conductor layer wound on a plane, an outer-circumferential lead-out conductor led out on the same plane as the coil conductor layer from an outer-circumferential end of the coil conductor layer, and an inner-circumferential lead-out conductor led out on the same plane as the coil conductor layer from an inner-circumferential end of the coil conductor layer. The coil component further comprises a branch conductor disposed to branch from at least one of the outer-circumferential lead-out conductor and the inner-circumferential lead-out conductor, and extending on the same plane as the coil conductor layer.

According to the coil component, since the branch conductor branching from at least one of the outer-circumferential lead-out conductor and the inner-circumferential lead-out conductor is disposed, the necessary characteristic of the coil component can easily be changed or adjusted by only changing the length of the branch conductor while suppressing an influence on other characteristics without changing an overall structure such as the number of turns, the line width, the distance between lines, and the winding shape of the coil conductor layer, for example.

In one embodiment of the coil component, the branch conductor extends along a winding direction of the coil conductor layer. According to the embodiment, since the branch conductor extends along the winding direction of the first coil conductor layer, the magnetic path of the first coil conductor layer is less blocked by the branch conductor so that deterioration in characteristic can be reduced.

In one embodiment of the coil component, a line width of the branch conductor and a line width of the coil conductor layer are the same. According to the embodiment, since the line width of the branch conductor and the line width of the coil conductor layer are the same, a signal loss of reflection etc. due to differences in electric resistance components between the branch conductor and the coil conductor layer can be reduced. If the branch conductor and the coil conductor layer are formed by electrolytic plating, a current density applied to the branch conductor and the coil conductor layer becomes uniform, so that variations in thickness can be suppressed in the branch conductor and the coil conductor layer.

In one embodiment of the coil component, the coil component has another coil conductor layer laminated on one of the upper and lower sides of the coil conductor layer and wound on a plane, and the branch conductor extends to overlap the other coil conductor layer when viewed in a lamination direction. According to the embodiment, since the branch conductor extends to overlap the other coil conductor layer when viewed in the lamination direction, the magnetic path of the other coil conductor layer is less blocked by the branch conductor so that deterioration in characteristic can be reduced. Since both the branch conductor and the other coil conductor layer overlapping each other are conductors, a lamination structure is stabilized.

In one embodiment of the coil component, the branch conductor is disposed to branch from the outer-circumferential lead-out conductor. According to the embodiment, since the branch conductor is disposed to branch from the outer-circumferential lead-out conductor, the characteristic of the coil component can more easily be changed or adjusted.

In one embodiment of the coil component, the coil conductor layer and the other coil conductor layer constitute a common mode choke coil, and a proportion of the length of the branch conductor to the length of the coil conductor layer is 5% or more and 18% or less (i.e., from 5% to 18%). According to the embodiment, since the proportion of the length of the branch conductor is 18.0% or less, an amount of decrease in peak attenuation value of Scc21 can be 3 dB or less as compared to when the branch conductor is not disposed. As a result, the characteristic can be changed without significantly deteriorating the attenuation characteristic of Scc21. On the other hand, since the proportion of the length of the branch conductor is 5% or more, the characteristic can efficiently be changed.

In one embodiment of the coil component, the branch conductor is one of a plurality of branch conductors. According to the embodiment, the characteristic of frequency of the coil component can be changed or adjusted in a wider range.

In one embodiment of the coil component, the coil conductor layer has an aspect ratio of 1 or more and 2.5 or less (i.e., from 1 to 2.5). According to the embodiment, a high-frequency characteristic is improved.

In one embodiment of the coil component, the coil conductor layer has a thickness of 5 μm or more and 15 μm or less (i.e., from 5 μm to 15 μm). According to the embodiment, the coil component can be made thinner.

In one embodiment of the coil component, the coil component further comprises an element body having a plurality of laminated insulating layers, and the coil conductor layer is wound on the insulating layer. According to the embodiment, the coil conductor layer is insulated by the insulating layers.

In one embodiment of the coil component, the coil component further comprises magnetic substrates sandwiching the element body. According to the embodiment, impedance can be improved.

In one embodiment of the coil component, the coil component further comprises a first external electrode electrically connected to the outer-circumferential lead-out conductor, and a second external electrode electrically connected to the inner-circumferential lead-out conductor. According to the embodiment, by using one and the other of the first external electrode and the second external electrode as an input terminal and an output terminal, respectively, an electric connection of the coil component can be achieved.

In one embodiment of the coil component, the magnetic substrates have a quadrangular shape when viewed in the lamination direction, and the first external electrode and the second external electrode are disposed on two respective opposite sides of the quadrangular shape. According to the embodiment, the input terminal and the output terminal can be arranged on the opposite sides, which makes wiring design easy.

An embodiment of a method of changing a frequency characteristic of a coil component provides a method of changing a characteristic of frequency of the coil component, wherein the characteristic of frequency of the coil component is changed by changing the length of the branch conductor. According to the embodiment, the necessary characteristic of the coil component can easily be changed or adjusted by only changing the length of the branch conductor while suppressing an influence on other characteristics without changing an overall structure such as the number of turns, the line width, the distance between lines, and the winding shape of the coil conductor layer.

According to the coil component and the method of changing a frequency characteristic thereof of the present disclosure, the necessary characteristic of the coil component can easily be changed or adjusted while suppressing the influence on other characteristics.

DETAILED DESCRIPTION

The present disclosure will now be described in detail with reference to shown embodiments.

First Embodiment

Figure 1:
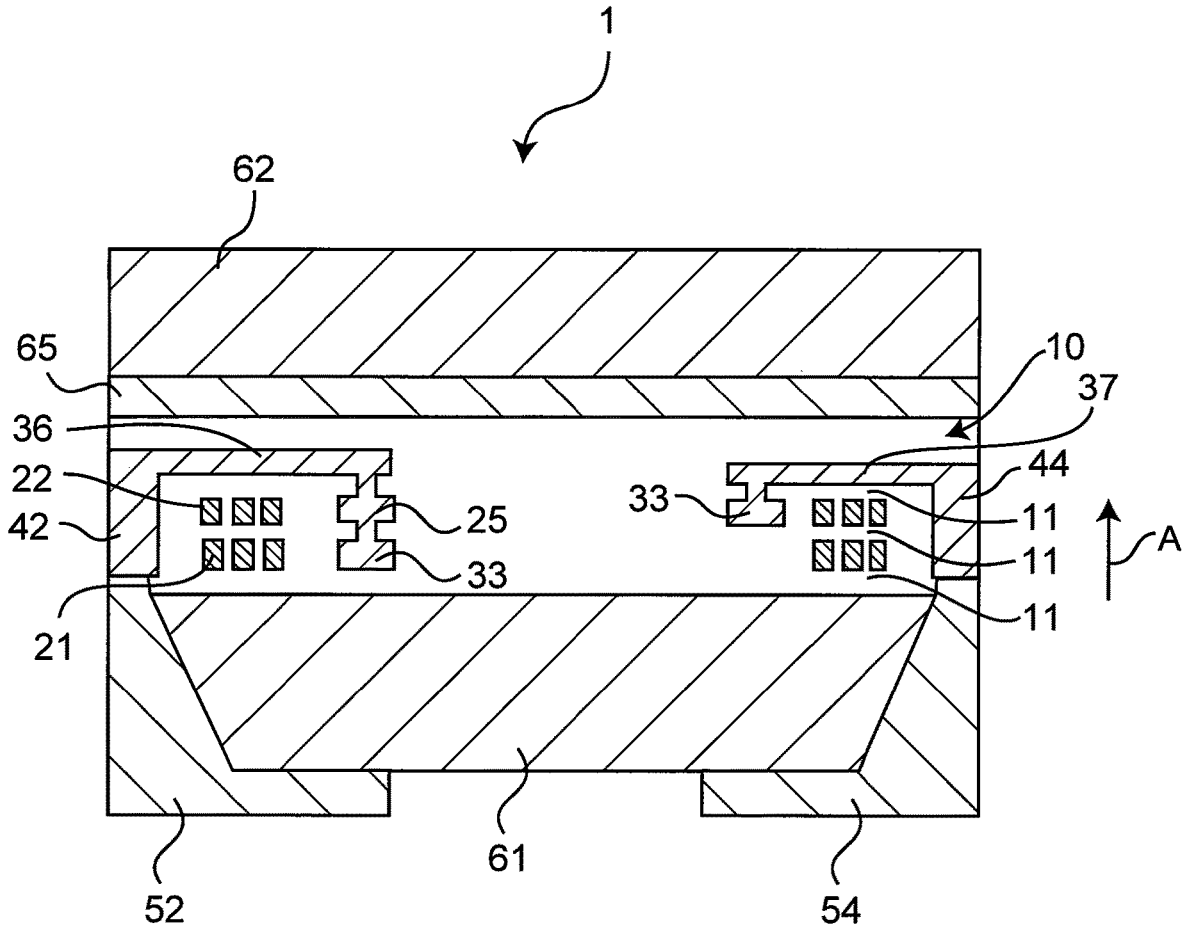
FIG. 1 is a cross-sectional view of a first embodiment of a coil component of the present disclosure.
Figure 2A:
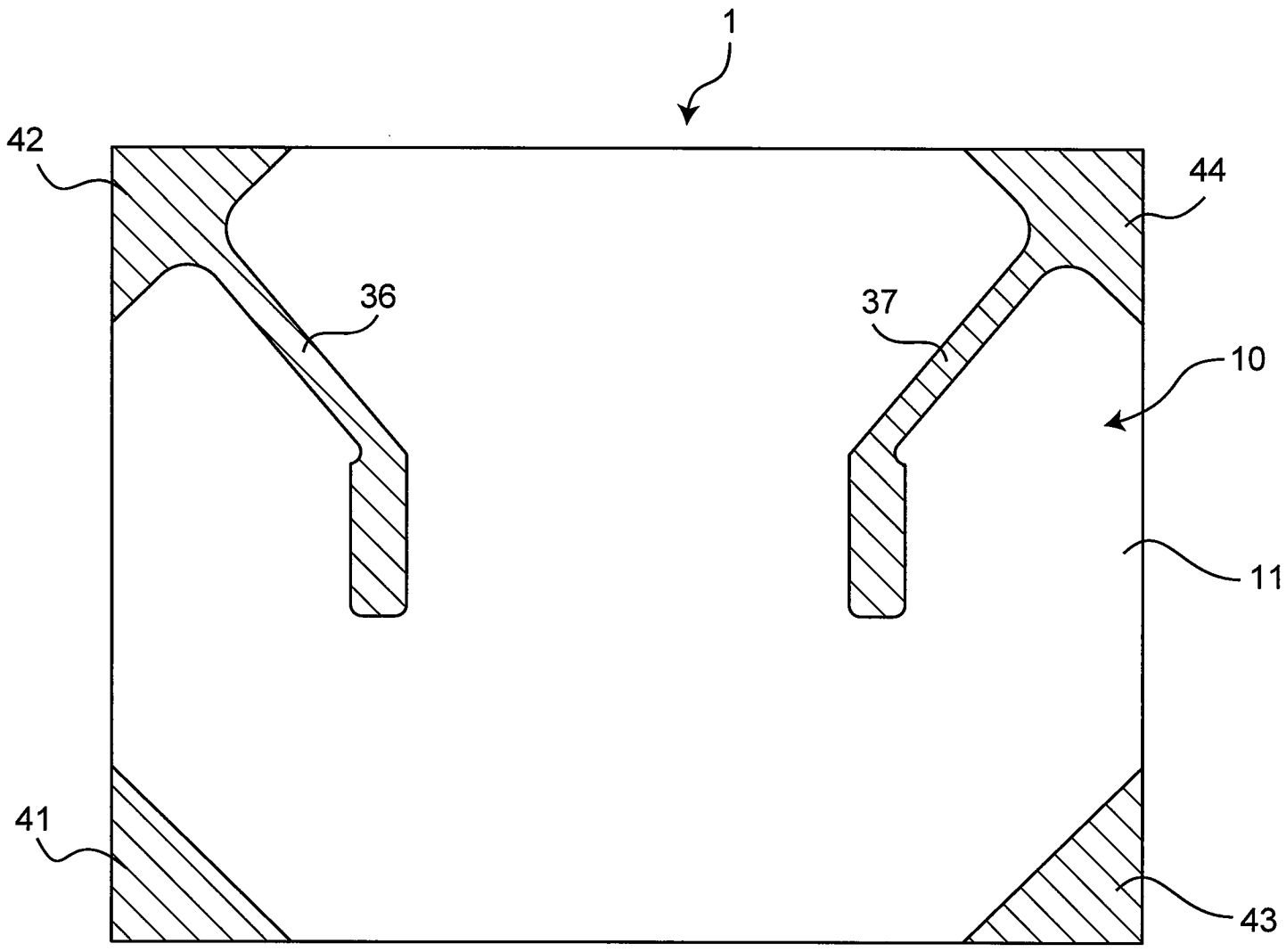
FIG. 2A is an exploded plane view of a portion of the coil component.
Figure 2B:
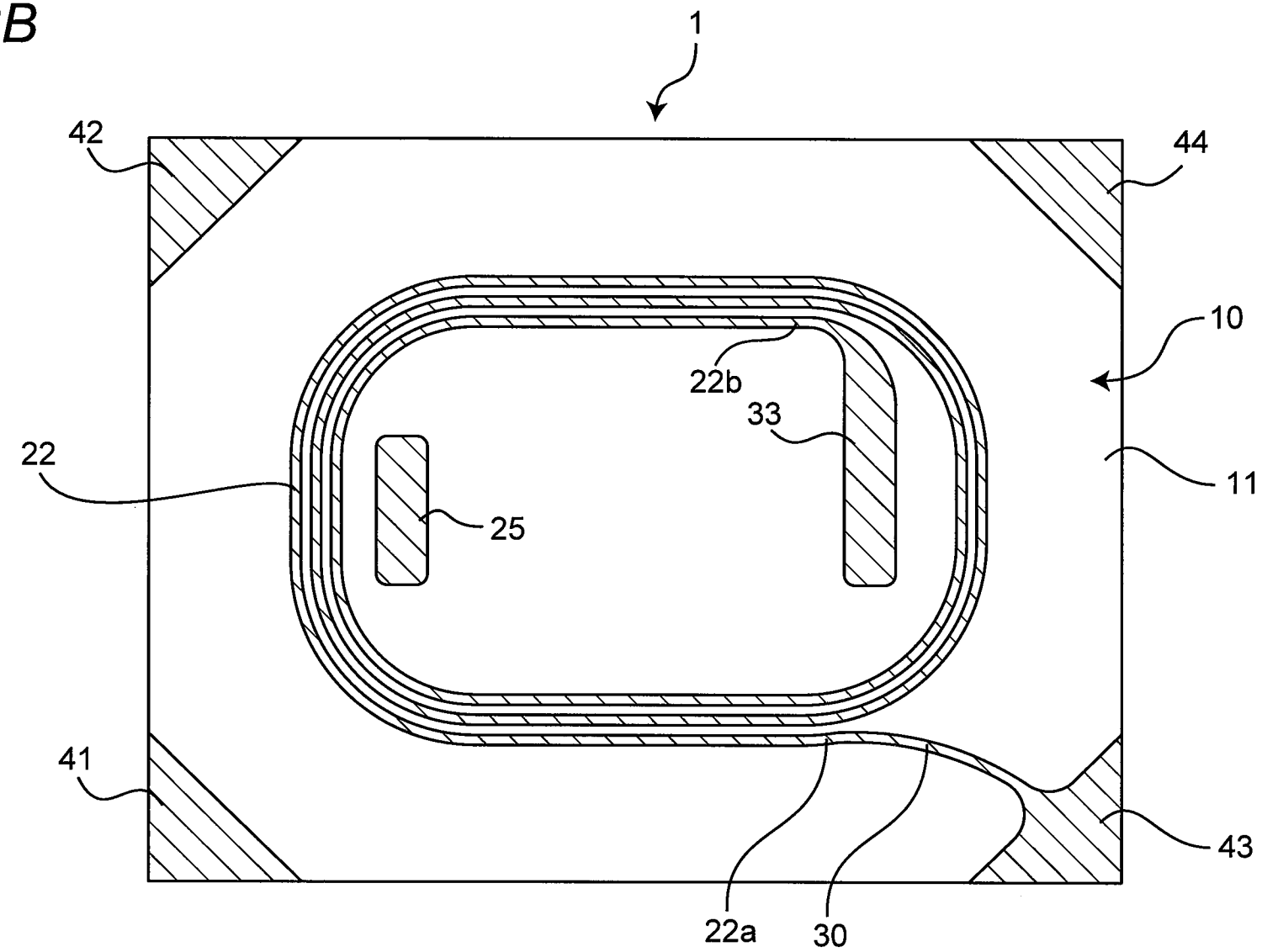
FIG. 2B is an exploded plane view of a portion of the coil component.
Figure 2C:
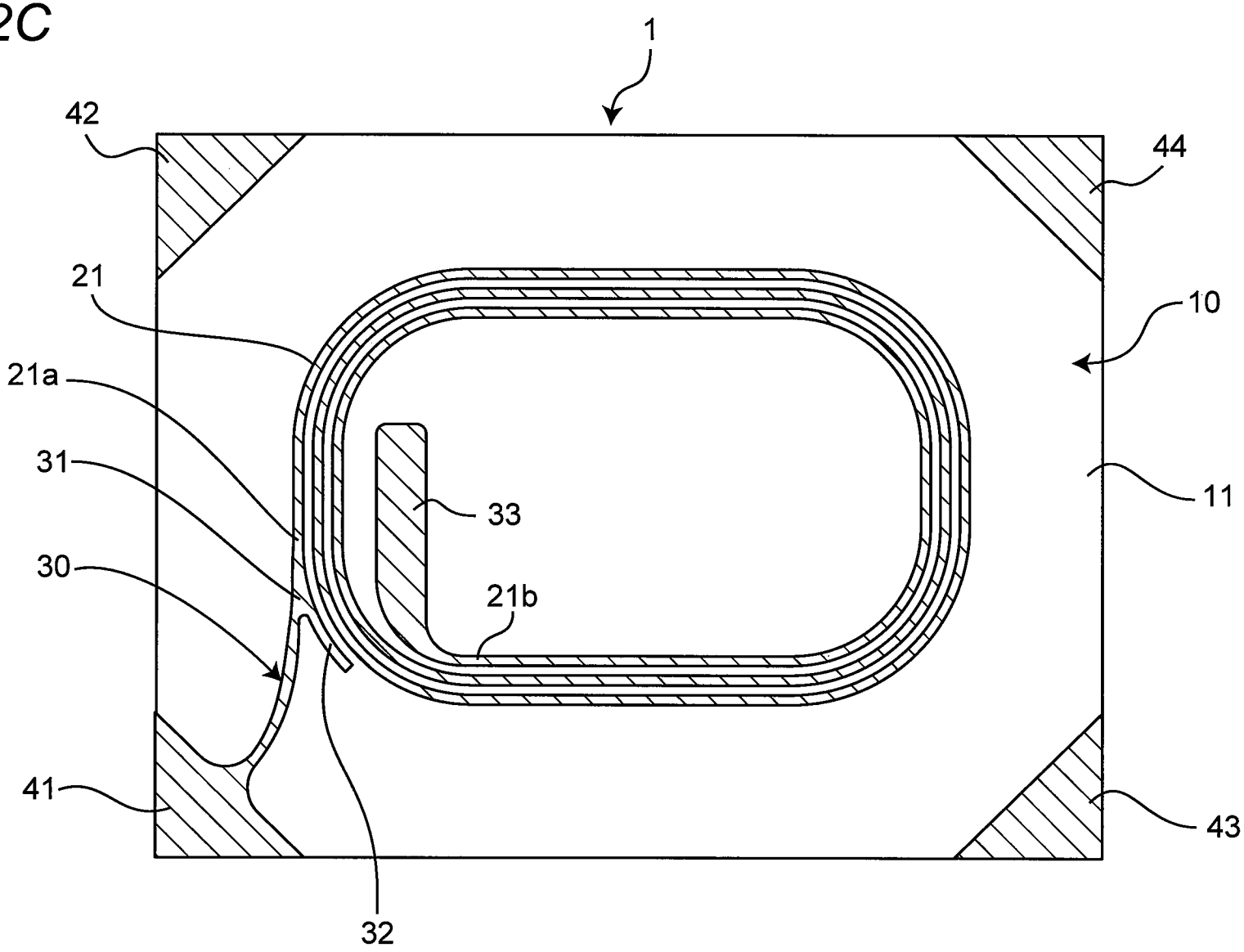
FIG. 2C is an exploded plane view of a portion of the coil component.

FIG. 1 is a cross-sectional view of a first embodiment of a coil component. FIGS. 2A, 2B, and 2C are exploded plane views of a portion of the coil component. As shown in FIGS. 1 and 2A to 2C, a coil component 1 has an element body 10, a first coil conductor layer 21 and a second coil conductor layer 22 disposed within the element body 10, and connection electrodes 41 to 44 and external electrodes 51 to 54 (external electrodes 51, 53 are not shown) electrically connected to the first and second coil conductor layers 21, 22. The first and second coil conductor layers 21, 22 constitute a common mode choke coil.

The coil component 1 is electrically connected through the connection electrodes 41 to 44 and the external electrodes 51 to 54 to a wiring of a circuit board not shown. The coil component 1 is used as a common mode choke coil, for example, and is used for an electronic device such as a personal computer, a DVD player, a digital camera, a TV, a portable telephone, automotive electronics, and medical/industrial machines.

The element body 10 includes multiple insulating layers 11, and the multiple insulating layers 11 are laminated in a lamination direction A. The insulating layers 11 is made of an insulating material mainly composed of resin, ferrite, and glass, for example. In the element body 10, an interface between the multiple insulating layers 11 may not be clear due to firing etc. The element body 10 is formed into a substantially rectangular parallelepiped shape. In FIG. 1, the lamination direction A is defined as a vertical direction. FIGS. 2A to 2C show layers in order from an upper layer to a lower layer. The lamination direction A merely shows an order in a process, and the top and bottom of the coil component 1 may be reversed (configuration in which the external electrodes 51 to 54 are on the upper side).

A first substrate 61 is disposed on a lower surface of the element body 10, and a second substrate 62 is disposed on an upper surface of the element body 10. The second substrate 61 is attached via an adhesive 65 to the upper surface of the element body 10. The first and second substrates 61, 62 are ferrite substrates, for example. A ferrite material used for the first and second substrates 61, 62 may be a magnetic or nonmagnetic material, and an impedance can be improved in the case of the magnetic material. The first and second substrates 61, 62 may be made of a material other than ferrite, such as alumina and glass.

The connection electrodes 41 to 44 and the external electrodes 51 to 54 are made of a conductive material such as Ag, Cu, Au, and an alloy mainly composed thereof, for example. The electrodes include the first to fourth connection electrodes 41 to 44 and the first to fourth external electrodes 51 to 54. The first to fourth connection electrodes 41 to 44 are respectively embedded in corner portions of the element body 10 along the lamination direction A. The first to fourth external electrodes 51 to 54 are disposed from the lower surface to the side surface of the element body 10. The first connection electrode 41 is connected to the first external electrode 51; the second connection electrode 42 is connected to the second external electrode 52; the third connection electrode 43 is connected to the third external electrode 53; and the fourth connection electrode 44 is connected to the fourth external electrode 54.

By using one and the other of the first and second external electrodes 51, 52 as an input terminal and an output terminal, respectively, and using one and the other of the third and fourth external electrodes 53, 54 as an input terminal and an output terminal, respectively, an electric connection of the coil component 1 can be achieved. The first and second substrates 61, 62 have a quadrangular shape when viewed in the lamination direction, and the first and second external electrodes 51, 52 are disposed on two respective opposite sides of the quadrangular shape, and the third and fourth external electrodes 53, 54 are disposed on two respective opposite sides of the quadrangular shape. Therefore, the input terminals and the output terminals can be arranged on the opposite sides, which makes wiring design easy.

The first coil conductor layer 21 and the second coil conductor layer 22 are made of the same conductive material as the connection electrodes 41 to 44 and the external electrodes 51 to 54, for example. The first and second coil conductor layers 21, 22 each have a flat spiral shape wound on a plane. The numbers of turns of the first and second coil conductor layers 21, 22 are not less than one or may be less than one. The first and second coil conductor layers 21, 22 are disposed on respective different insulating layers 11 and are arranged in the lamination direction A. The first coil conductor layer 21 is disposed on the lower side of the second coil conductor layer 22.

An outer-circumferential lead-out conductor 30 and an inner-circumferential lead-out conductor 33 are disposed on the same plane (on the same insulating layer 11) as the first coil conductor layer 21. The outer-circumferential lead-out conductor 30 is led outward from an outer-circumferential end 21*a* of the first coil conductor layer 21 and connected to the first connection electrode 41. The outer-circumferential end 21*a* refers to a portion deviated from the spiral shape of the first coil conductor layer 21, and the outer-circumferential lead-out conductor 30 refers to a portion after the outer-circumferential end 21*a*. The outer-circumferential lead-out conductor 30 and the first coil conductor layer 21 are integrally formed.

The inner-circumferential lead-out conductor 33 is led inward from an inner-circumferential end 21*b* of the first coil conductor layer 21 and connected to the connection conductor 25 disposed in the element body 10 along the lamination direction A. The inner-circumferential end 21*b* refers to a portion deviated from the spiral shape of the first coil conductor layer 21, and the inner-circumferential lead-out conductor 33 refers to a portion after the inner-circumferential end 21*b*. The inner circumference lead-out conductor 33 and the first coil conductor layer 21 are integrally formed. The connection conductor 25 is connected to a first lead-out wiring 36 disposed on the insulating layer 11 on the upper side of the second coil conductor layer 22, and the first lead-out wiring 36 is connected to the second connection electrode 42. In this way, the first coil conductor layer 21 is connected to the first connection electrode 41 and the second connection electrode 42.

An outer-circumferential lead-out conductor 30 and an inner-circumferential lead-out conductor 33 are disposed on the same plane (on the same insulating layer 11) as the second coil conductor layer 22. The outer-circumferential lead-out conductor 30 is led outward from an outer-circumferential end 22*a* of the second coil conductor layer 22 and connected to the third connection electrode 43.

The inner circumference lead-out conductor 33 is led inward from an inner-circumferential end 22*b* of the second coil conductor layer 22 and connected to a second lead-out wiring 37 disposed on the insulating layer 11 on the upper side of the second coil conductor layer 22. The second lead-out wiring 37 is connected to the fourth connection electrode 44. In this way, the second coil conductor layer 22 is connected to the third connection electrode 43 and the fourth connection electrode 44.

The first coil conductor layer 21 and the second coil conductor layer 22 concentrically overlap when viewed from the lamination direction A. In this case, "overlap" means that the spiral shape of the first coil conductor layer 21 and the spiral shape of the second coil conductor layer 22 substantially overlap.

The aspect ratio of the first coil conductor layer 21 and the second coil conductor layer 22 is preferably 1 or more and 2.5 or less (i.e., from 1 to 2.5). As a result, a high-frequency characteristic is improved. The thickness of the first coil conductor layer 21 and the second coil conductor layer 22 is preferably 5 μm or more and 15 μm or less (i.e., from 5 μm to 15 μm). As a result, the coil component can be made thinner.

Figure 3:
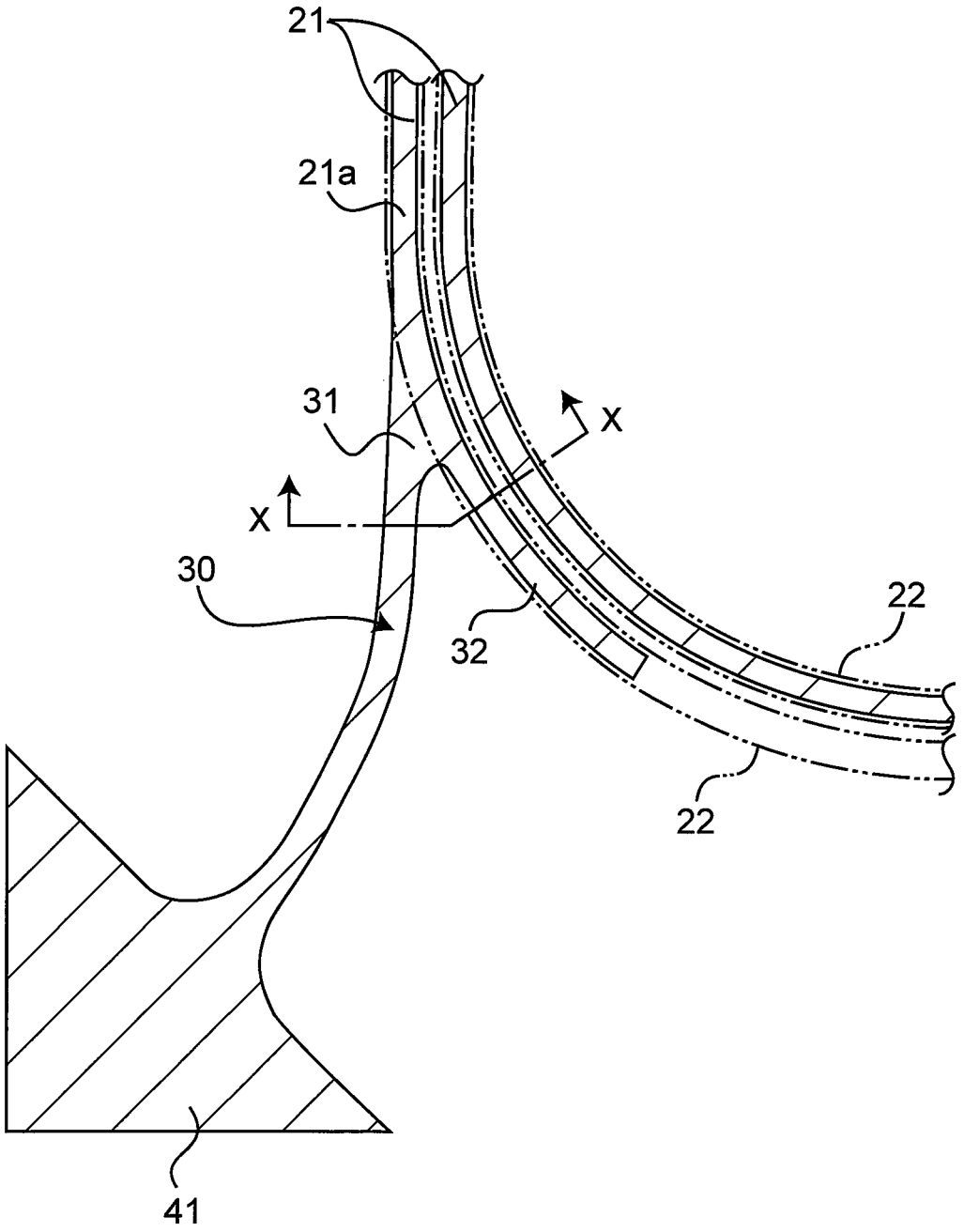
FIG. 3 is an enlarged view of an outer-circumferential lead-out conductor viewed in a lamination direction.

FIG. 3 is an enlarged view of the vicinity of the outer-circumferential lead-out conductor 30 viewed in the lamination direction. In FIG. 3, the outer-circumferential lead-out conductor 30, the first coil conductor layer 21, and the first connection electrode 41 are indicated by hatching, and the second coil conductor layer 22 located thereabove is indicated by imaginary lines. Although the line width of the second coil conductor layer 22 is drawn wider than the line width of the first coil conductor layer 21, the line widths are actually the same. The line width of the first coil conductor layer 21 may be different from the line width of the second coil conductor layer 22.

As shown in FIG. 3, a branch conductor 32 is disposed to branch from the outer-circumferential lead-out conductor 30. The branch conductor 32 extends on the same plane as the first coil conductor layer 21. The outer-circumferential lead-out conductor 30 includes a connecting portion 31 connected to the first coil conductor layer 21. The branch conductor 32 is connected to the connecting portion 31. In FIG. 3, the connecting portion 31 is a portion between the outer-circumferential end 21*a* and a bifurcated position. The branch conductor 32 extends from the connecting portion 31.

The branch conductor 32 extends along the winding direction of the first coil conductor layer 21. The line width of the branch conductor 32 and the line width of the first coil conductor layer 21 are the same. The line width in this case refers to a dimension orthogonal to an extending direction of the branch conductor 32 and the first coil conductor layer 21 when viewed in the lamination direction. The branch conductor 32 extends to overlap with the second coil conductor layer 22 when viewed in the lamination direction. A proportion of the length of the branch conductor 32 to the length of the first coil conductor layer 21 (hereinafter referred to as the proportion of length of the branch conductor 32) is preferably 5% or more and 18% or less (i.e., from 5% to 18%). The length in this case refers to a wiring length, i.e., the length of the first coil conductor layer 21 and the branch conductor 32 along the extending shape.

A method of manufacturing the coil component 1 will be described. A manufacturing method in an X-X cross section of FIG. 3 will be described. The X-X cross section of FIG. 3 is a cross section in a direction orthogonal to the extending directions of a portion of the outer-circumferential lead-out conductor 30 after the connecting portion 31, the branch conductor 32, and the first coil conductor layer 21.

Figure 4A:
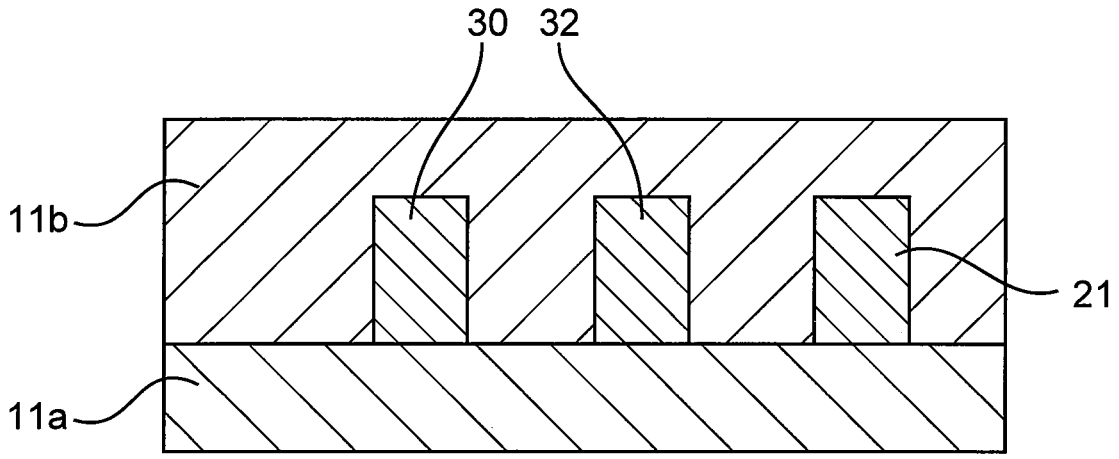
FIG. 4A is an explanatory view for explaining a manufacturing method of the coil component.
Figure 4B:
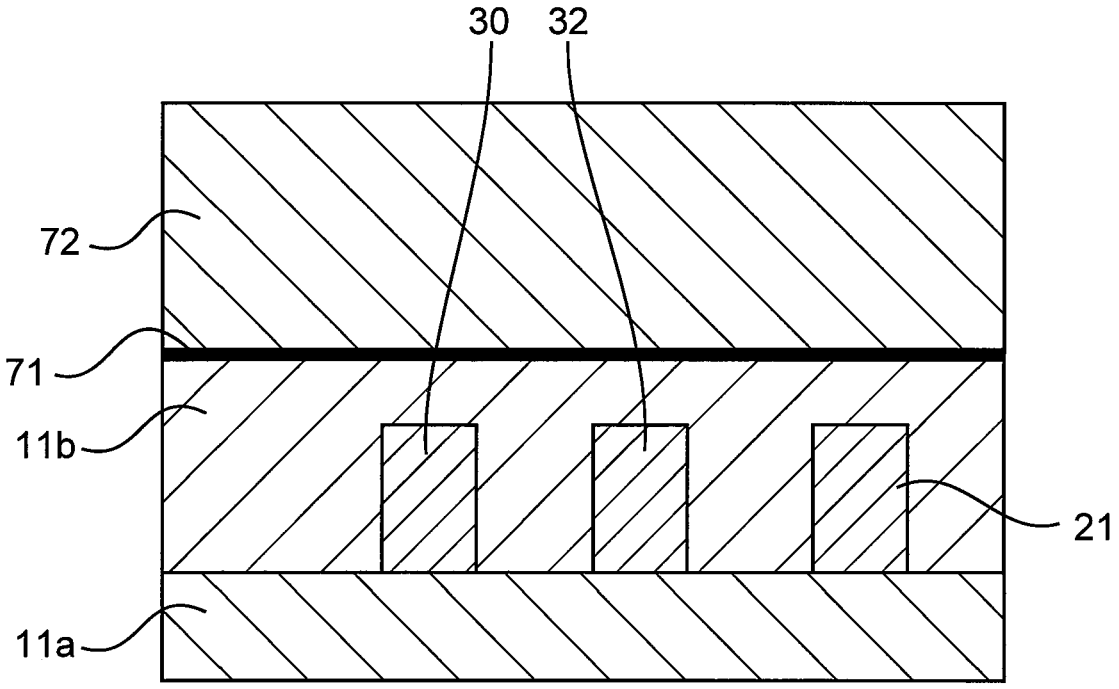
FIG. 4B is an explanatory view for explaining a manufacturing method of the coil component.

As shown in FIG. 4A, the first coil conductor layer 21, the outer-circumferential lead-out conductor 30, and the branch conductor 32 are disposed on the first insulating layer 11*a*. A second insulating layer 11*b* is then laminated on the first coil conductor layer 21 and the outer-circumferential lead-out conductor 30. Subsequently, as shown in FIG. 4B, a power feeding film 71 is disposed on the upper surface of the second insulating layer 11*b*, and a photoresist 72 is disposed on the power feeding film 71.

Figure 4C:
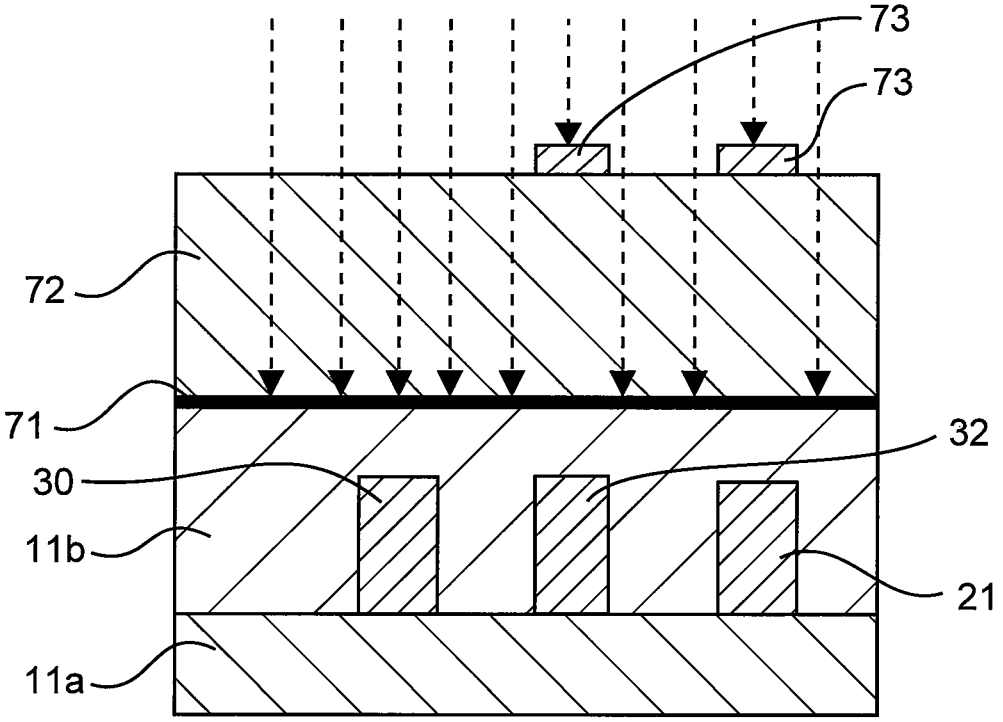
FIG. 4C is an explanatory view for explaining a manufacturing method of the coil component.

Subsequently, as shown in FIG. 4C, a mask 73 is disposed on the photoresist 72 to overlap the first coil conductor layer 21 and the branch conductor 32 when viewed in the lamination direction. The photoresist 72 is a negative resist. Then, the photoresist 72 is exposed. Light used for exposure goes into the photoresist 72 as indicated by dotted arrows.

Figure 4D:
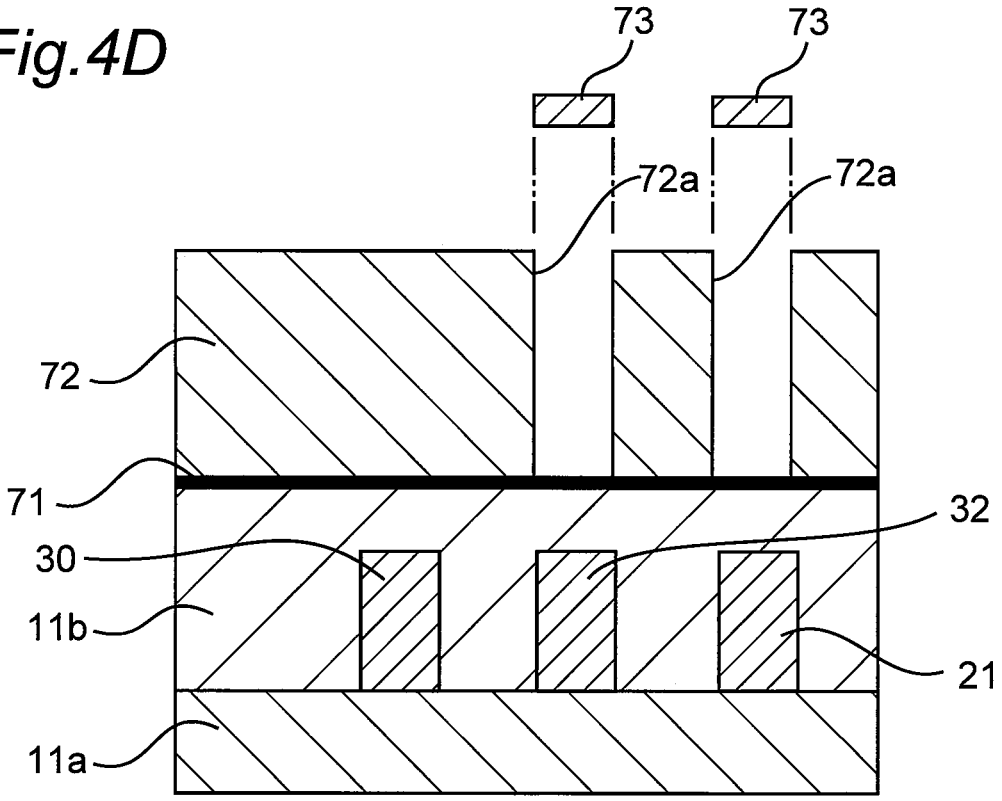
FIG. 4D is an explanatory view for explaining a manufacturing method of the coil component.
Figure 4E:
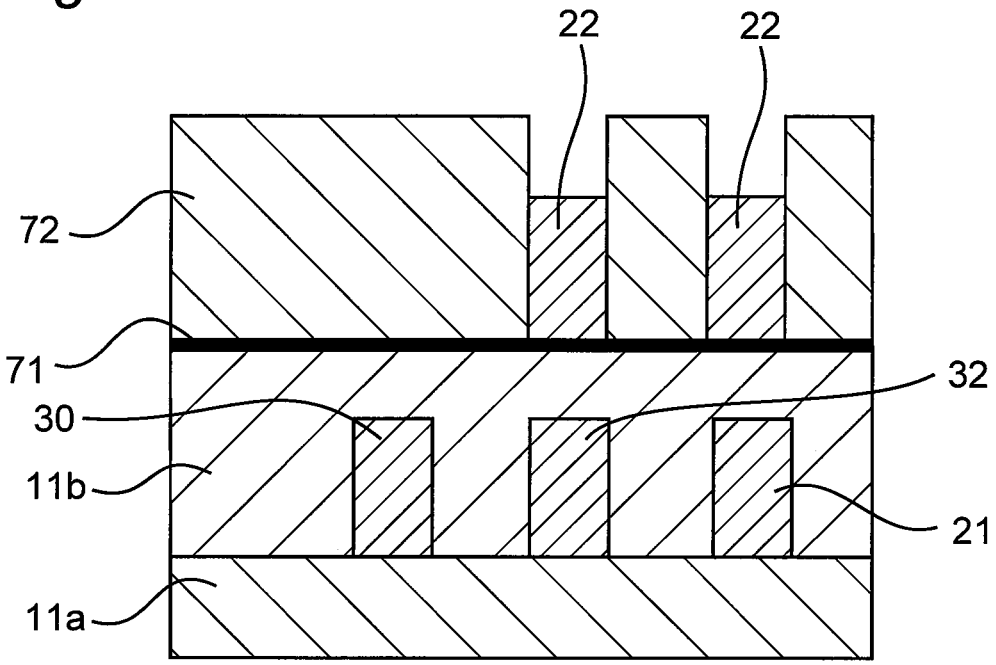
FIG. 4E is an explanatory view for explaining a manufacturing method of the coil component.

Subsequently, as shown in FIG. 4D, the mask 73 is removed and a portion not exposed due to the mask 73 is removed by development to form an opening 72*a* in the photoresist 72. Subsequently, as shown in FIG. 4E, the second coil conductor layer 22 is disposed in the removed portion (the opening portion 72*a*) of the photoresist 72. The second coil conductor layer 22 is formed by plating by energizing the power feeding film 71.

Figure 4F:
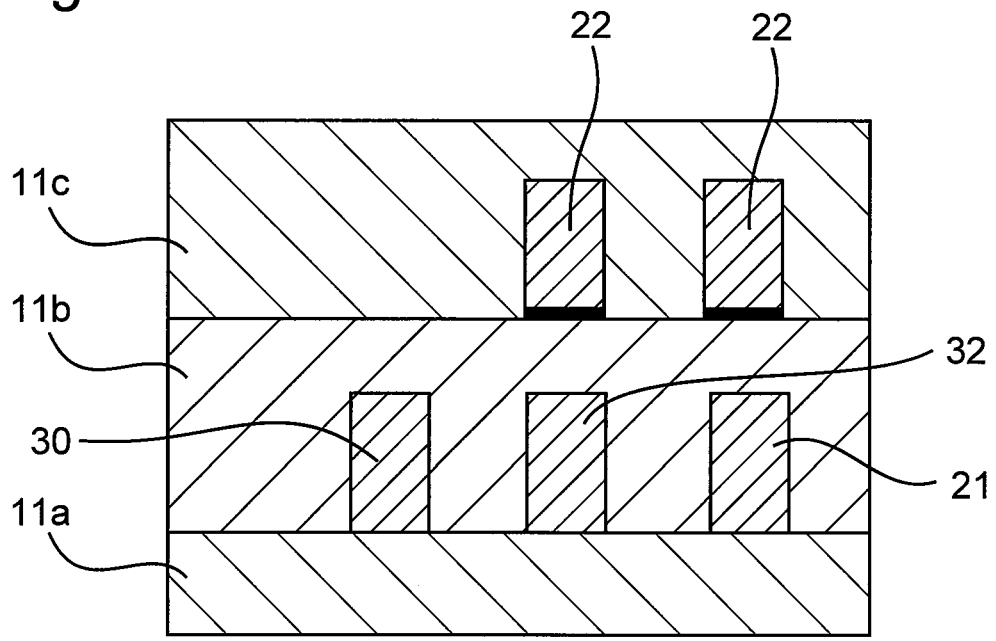
FIG. 4F is an explanatory view for explaining a manufacturing method of the coil component.

Subsequently, as shown in FIG. 4F, the photoresist 72 and the power feeding film 71 are removed, and a third insulating layer 11*c* is laminated on the second coil conductor layer 22. As shown in FIG. 1, the element body 10 formed as described above is formed on the first substrate 61, and the second substrate 62 is formed on the element body 10. Although the formation of the lead-out wirings 36, 37 and the connection electrodes 41 to 44 etc. will not be described, a known method may be used. Subsequently, the external electrodes 51 to 54 are disposed to manufacture the coil component 1.

According to the coil component 1, since the branch conductor 32 is disposed at the outer-circumferential lead-out conductor 30, the characteristic of frequency of the coil component 1 can easily be changed or adjusted by only changing the length of the branch conductor 32 without changing the overall structure such as the number of turns, the line width, the distance between lines, and the winding shape of the coil conductor layers 21, 22, for example. Since the characteristic is changed or adjusted by the branch conductor 32 as described above and the overall structure of the coil conductor layers 21, 22 is not changed, an influence on the main characteristics such as impedance and Rdc can be suppressed.

Figure 5:
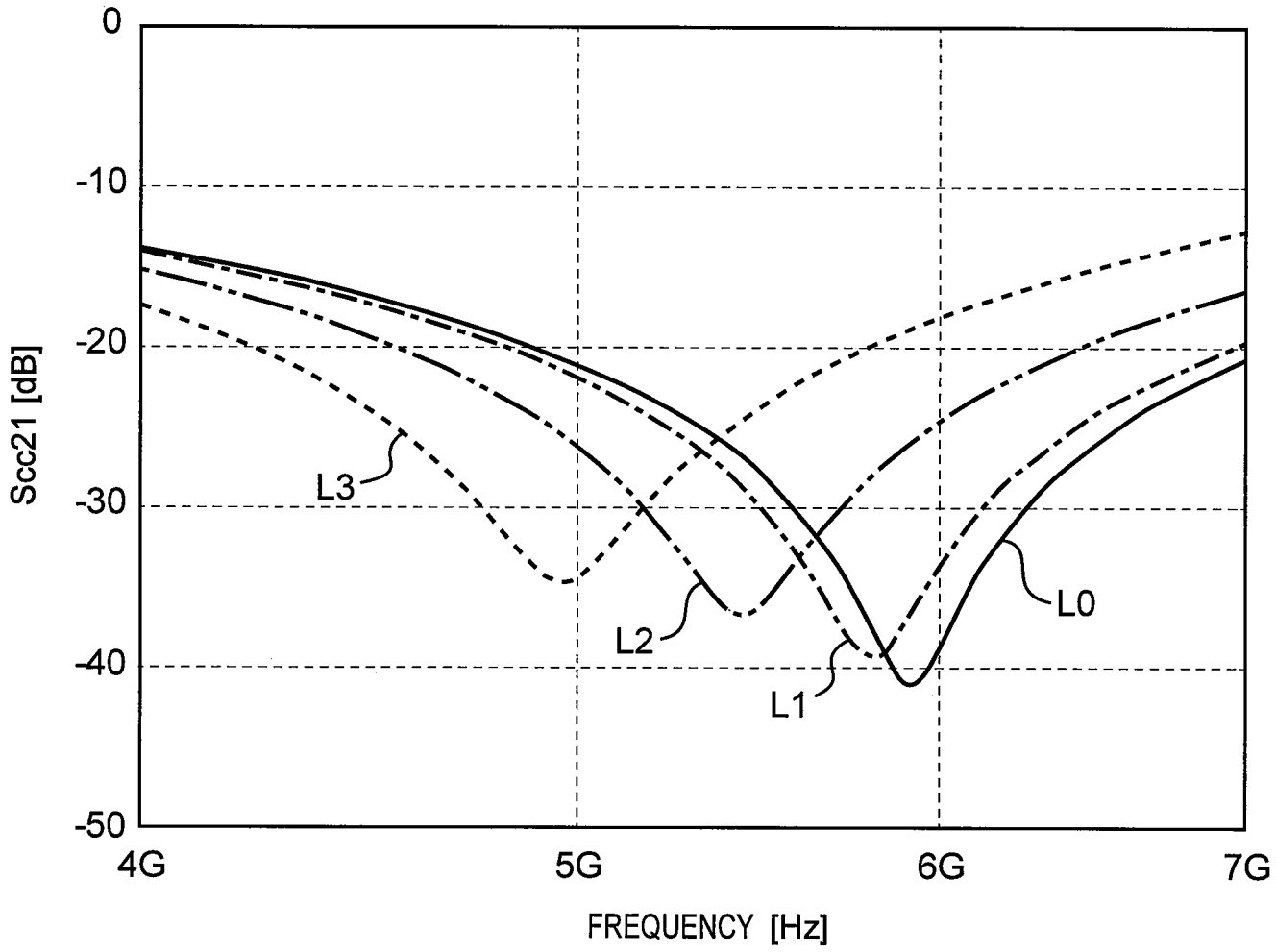
FIG. 5 is a graph of a relationship between a proportion of length of a branch conductor and an Scc21 characteristic.

For example, FIG. 5 shows a relationship between the proportion of length of the branch conductor 32 and the Scc21 characteristic when the coil component 1 is a common mode choke coil. In FIG. 5, the vertical axis represents Scc21 (dB) and the horizontal axis represents frequency (Hz). FIG. 5 includes a graph L0 (solid line) showing a state in which the branch conductor 32 is not disposed, a graph L1 (dashed-dotted line) showing a state in which the proportion of length of the branch conductor 32 is 10.6%, a graph L2 (dashed-two dotted line) showing a state in which the proportion of length of the branch conductor 32 is 23.8%, and a graph L3 (dotted line) showing a state in which the proportion of length of the branch conductor 32 is 37.4%.

As shown in FIG. 5, by increasing the length of the branch conductor 32, a maximum attenuation frequency of the Scc21 characteristic can be set to a low frequency band. In other words, by only changing a design of a photomask for manufacturing the branch conductor 32, the frequency characteristic of Scc21 can be changed. In contrast, the conventional change or adjustment method requires changing both photomasks for manufacturing the coil conductor layers 21, 22, which increases costs.

According to the coil component 1, since the branch conductor 32 extends along the winding direction of the first coil conductor layer 21, the magnetic path of the first coil conductor layer 21 is less blocked by the branch conductor 32 so that deterioration in characteristic can be reduced. Specifically, the Scc21 characteristic with higher attenuation can be achieved.

According to the coil component 1, since the line width of the branch conductor 32 and the line width of the first coil conductor layer 21 are the same, a signal loss of reflection etc. due to differences in electric resistance components between the branch conductor and the coil conductor layer can be reduced. If the branch conductor 32 and the first coil conductor layer 21 are formed by electrolytic plating, a current density applied to the branch conductor 32 and the first coil conductor layer 21 becomes uniform, so that variations in thickness can be suppressed in the branch conductor 32 and the first coil conductor layer 21.

According to the coil component 1, since the branch conductor 32 extends to overlap the second coil conductor layer 22 when viewed in the lamination direction, the magnetic path of the second coil conductor layer 22 is less blocked by the branch conductor 32 so that deterioration in characteristic can be reduced. Specifically, the Scc21 characteristic with higher attenuation can be achieved. Since both the branch conductor and the other coil conductor layer overlapping each other are conductors, a lamination structure is stabilized.

According to the coil component 1, since the branch conductor 32 is disposed at the outer-circumferential lead-out conductor 30, the characteristic of frequency of the coil component 1 can more easily be changed or adjusted. Specifically, as described later, a change in frequency characteristic per wiring length of branch conductor 32 becomes larger when the branch conductor 32 is disposed to branch from the outer-circumferential lead-out conductor 30 rather than being disposed to branch from the inner-circumferential lead-out conductor 33.

Figure 6A:
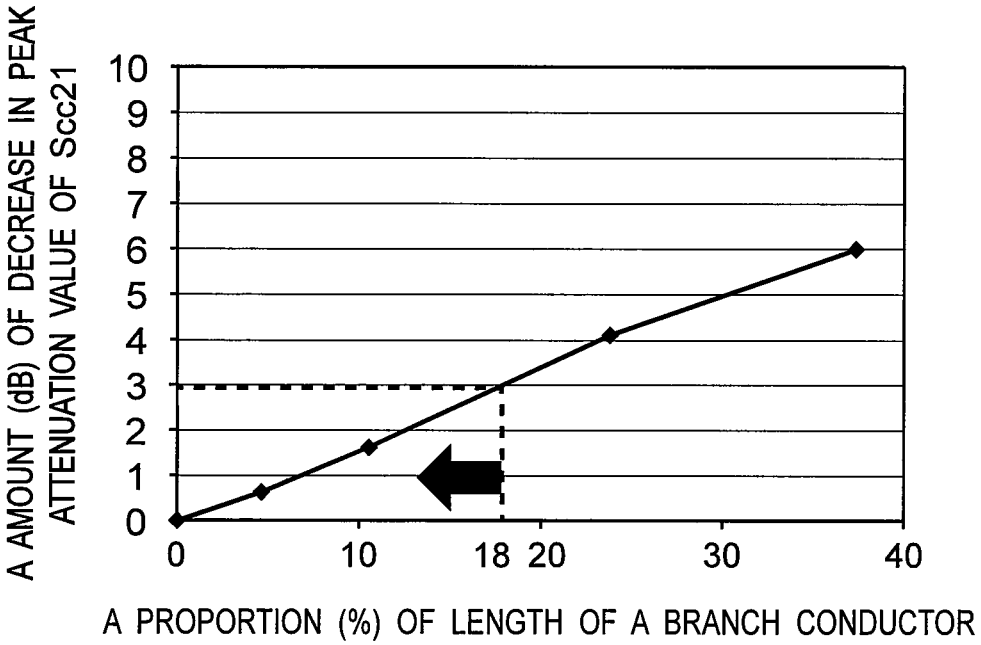
FIG. 6A is a graph of a relationship between an amount of decrease in peak attenuation value of Scc21 and a proportion of length of the branch conductor.

According to the coil component 1, since the proportion of the length of the branch conductor 32 is 18.0% or less, as shown in FIG. 6A, an amount of decrease in peak attenuation value of Scc21 can be 3 dB or less as compared to when the branch conductor 32 is not disposed. FIG. 6A is created based on the graph of FIG. 5, the vertical axis represents the amount (dB) of decrease in peak attenuation value of Scc21, and the horizontal axis represents the proportion (%) of length of the branch conductor 32. Therefore, the frequency characteristic can be changed without significantly deteriorating the attenuation characteristic of Scc21.

Figure 6B:
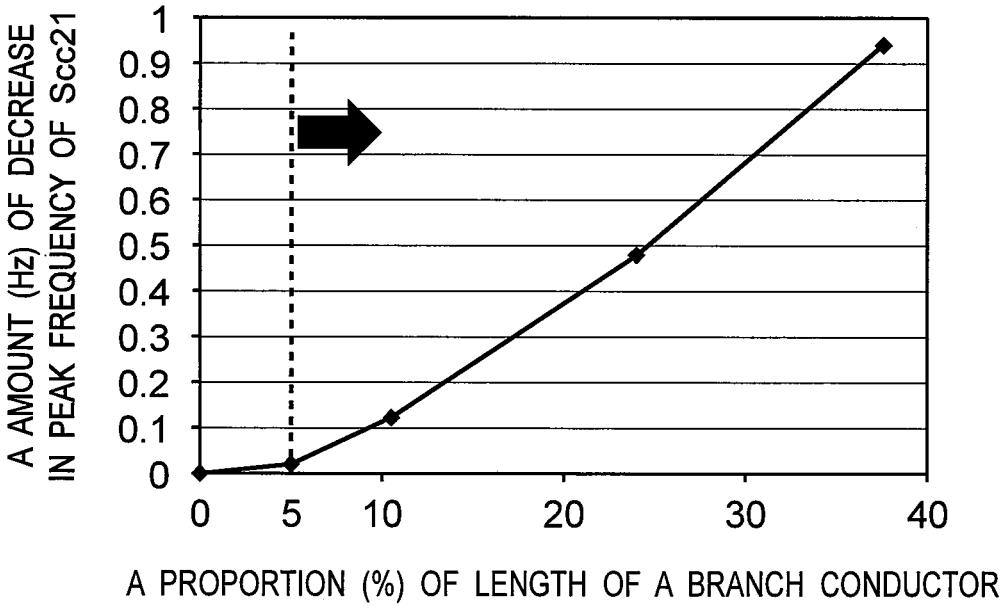
FIG. 6B is a graph of a relationship between an amount of decrease in peak frequency of Scc21 and a proportion of length of the branch conductor.

On the other hand, since the proportion of the length of the branch conductor 32 is 5% or more, the characteristic can efficiently be changed as shown in FIG. 6B. FIG. 6B is created based on the graph of FIG. 5, the vertical axis represents the amount (Hz) of decrease in peak frequency of Scc21, and the horizontal axis represents the proportion (%) of length of the branch conductor 32.

A method of changing the characteristic of frequency of the coil component 1 will be described. By changing the length of the branch conductor 32, the characteristic of frequency of the coil component 1 is changed. For example, as shown in FIGS. 5, 6A, and 6B, the characteristic of frequency is changed based on a relationship between the length of the branch conductor 32 and the characteristic of frequency. Therefore, by changing the length of the branch conductor 32, the characteristic of frequency of the coil component 1 can easily be changed.

Second Embodiment

Figure 7:
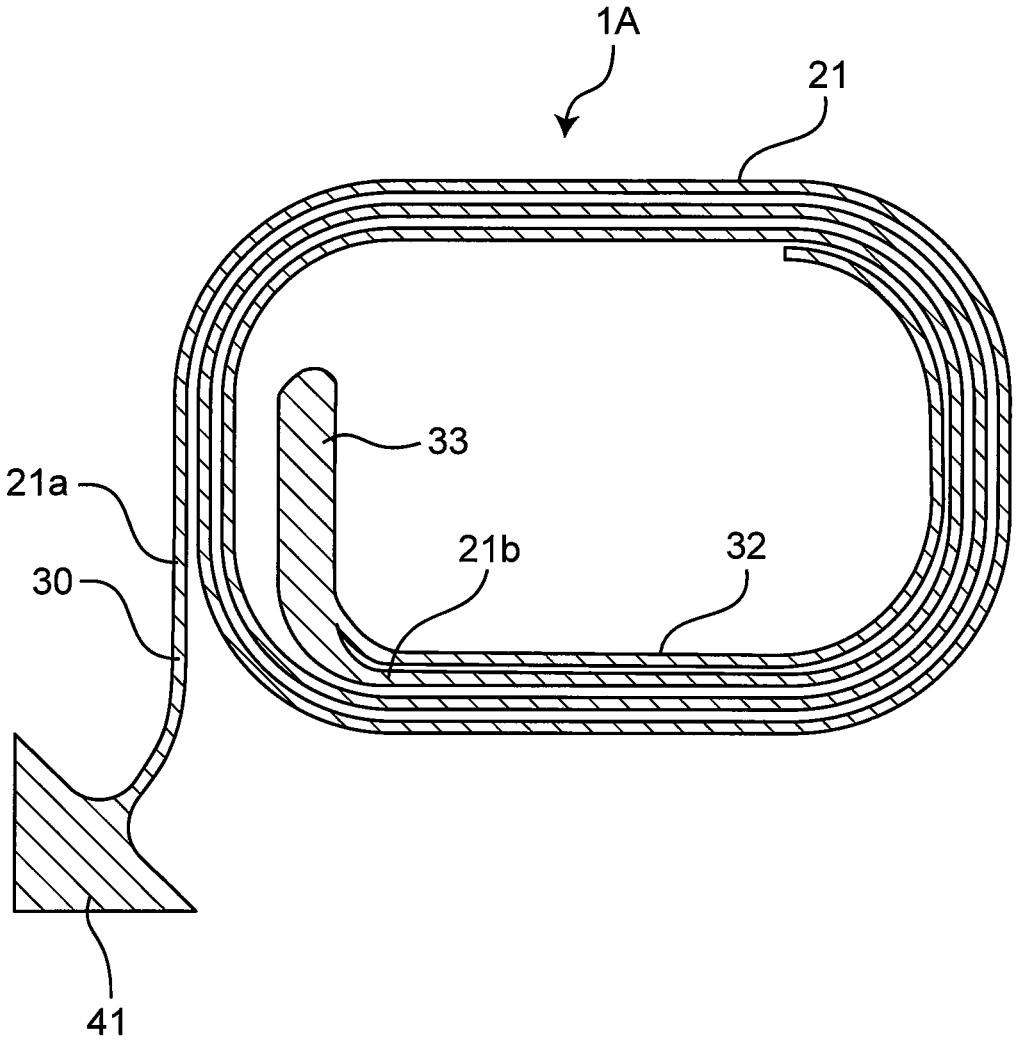
FIG. 7 is a plane view of a second embodiment of the coil component of the present disclosure.

FIG. 7 is a plane view of a second embodiment of the coil component of the present disclosure. The second embodiment is different from the first embodiment in the position of the branch conductor. This different configuration will hereinafter be described. The other constituent elements are configured as in the first embodiment and denoted by the same reference numerals as the first embodiment and will not be described.

As shown in FIG. 7, in a coil component 1A of the second embodiment, the branch conductor 32 is disposed at the inner-circumferential lead-out conductor 33 of the first coil conductor layer 21. The branch conductor 32 extends on the same plane as the first coil conductor layer 21. The branch conductor 32 extends along a direction opposite to the winding direction of the first coil conductor layer 21. The line width of the branch conductor 32 and the line width of the first coil conductor layer 21 are the same.

According to the coil component 1A, since the branch conductor 32 is disposed at the inner-circumferential lead-out conductor 33, the characteristic of frequency of the coil component 1A can easily be changed or adjusted by changing the length of the branch conductor 32, for example. Since the characteristic is changed or adjusted by the branch conductor 32 as described above and the overall structure of the coil conductor layers 21, 22 is not changed, an influence on the main characteristics such as impedance and Rdc can be suppressed.

Figure 8:
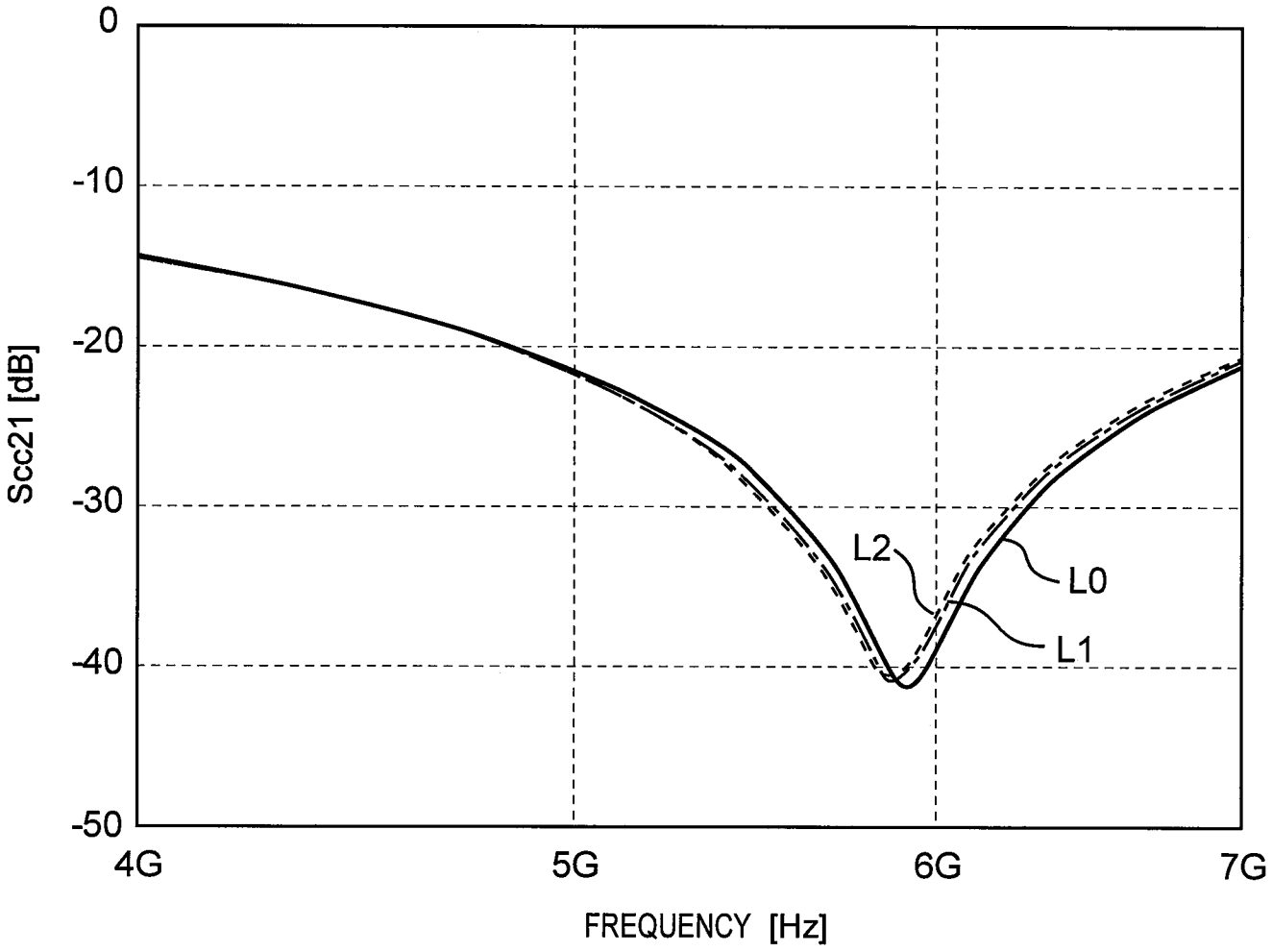
FIG. 8 is a graph of a relationship between a proportion of length of the branch conductor and the Scc21 characteristic.

For example, the Scc21 characteristic can be changed by changing a proportion of the length of the branch conductor 32 to the length of the first coil conductor layer 21 (hereinafter referred to as the proportion of length of the branch conductor 32). FIG. 8 shows a relationship between the length of the branch conductor 32 and the Scc21 characteristic when the coil component 1A is a common mode choke coil. In FIG. 8, the vertical axis represents Scc21 (dB) and the horizontal axis represents frequency (Hz). FIG. 8 includes a graph L0 (solid line) showing a state in which the branch conductor 32 is not disposed, a graph L1 (dashed-dotted line) showing a state in which the proportion of length of the branch conductor 32 is 6.8% and a graph L2 (dotted line) showing a state in which the proportion of length of the branch conductor 32 is 16.0%.

As shown in FIG. 8, by increasing the length of the branch conductor 32, a maximum attenuation frequency of the Scc21 characteristic can be set to a low frequency band. In other words, by only changing a design of a photomask for manufacturing the branch conductor 32, the frequency characteristic of Scc21 can be changed.

Figure 9A:
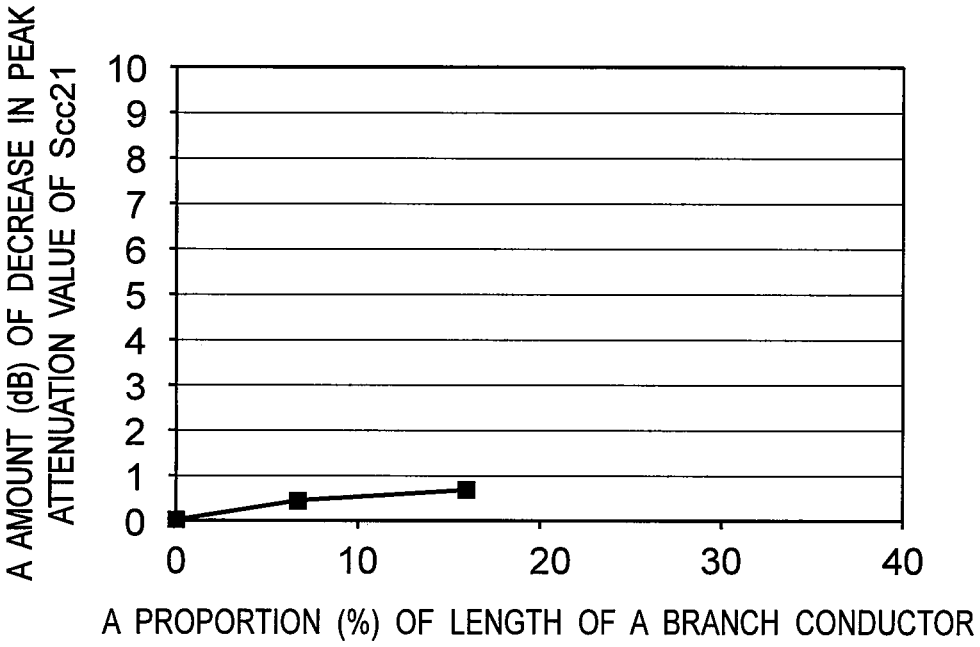
FIG. 9A is a graph of a relationship between an amount of decrease in peak attenuation value of Scc21 and a proportion of length of the branch conductor.
Figure 9B:
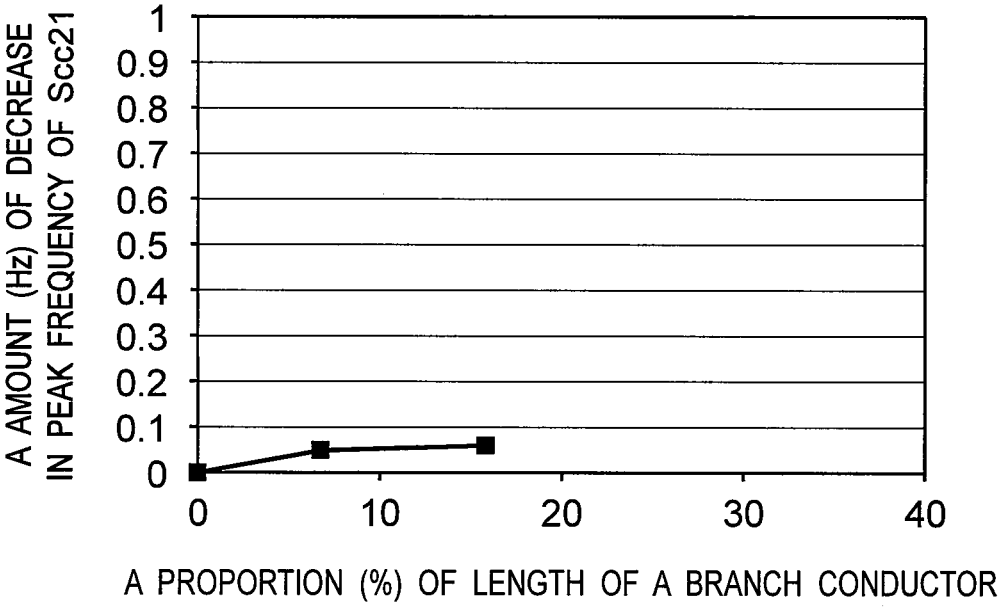
FIG. 9B is a graph of a relationship between an amount of decrease in peak frequency of Scc21 and a proportion of length of the branch conductor.

FIG. 9A shows a relationship between an amount (dB) of decrease in peak attenuation value of Scc21 and a proportion (%) of length of the branch conductor 32. FIG. 9B shows a relationship between an amount (Hz) of decrease in peak frequency of Scc21 and a proportion (%) of length of the branch conductor 32. FIGS. 9A and 9B are created based on the graph of FIG. 8. As shown in FIGS. 9A and 9B, by increasing the proportion of length of the branch conductor 32, the amount of decrease in peak attenuation value of Scc21 and the amount of decrease in peak frequency of Scc21 can be made larger.

Third Embodiment

Figure 10:
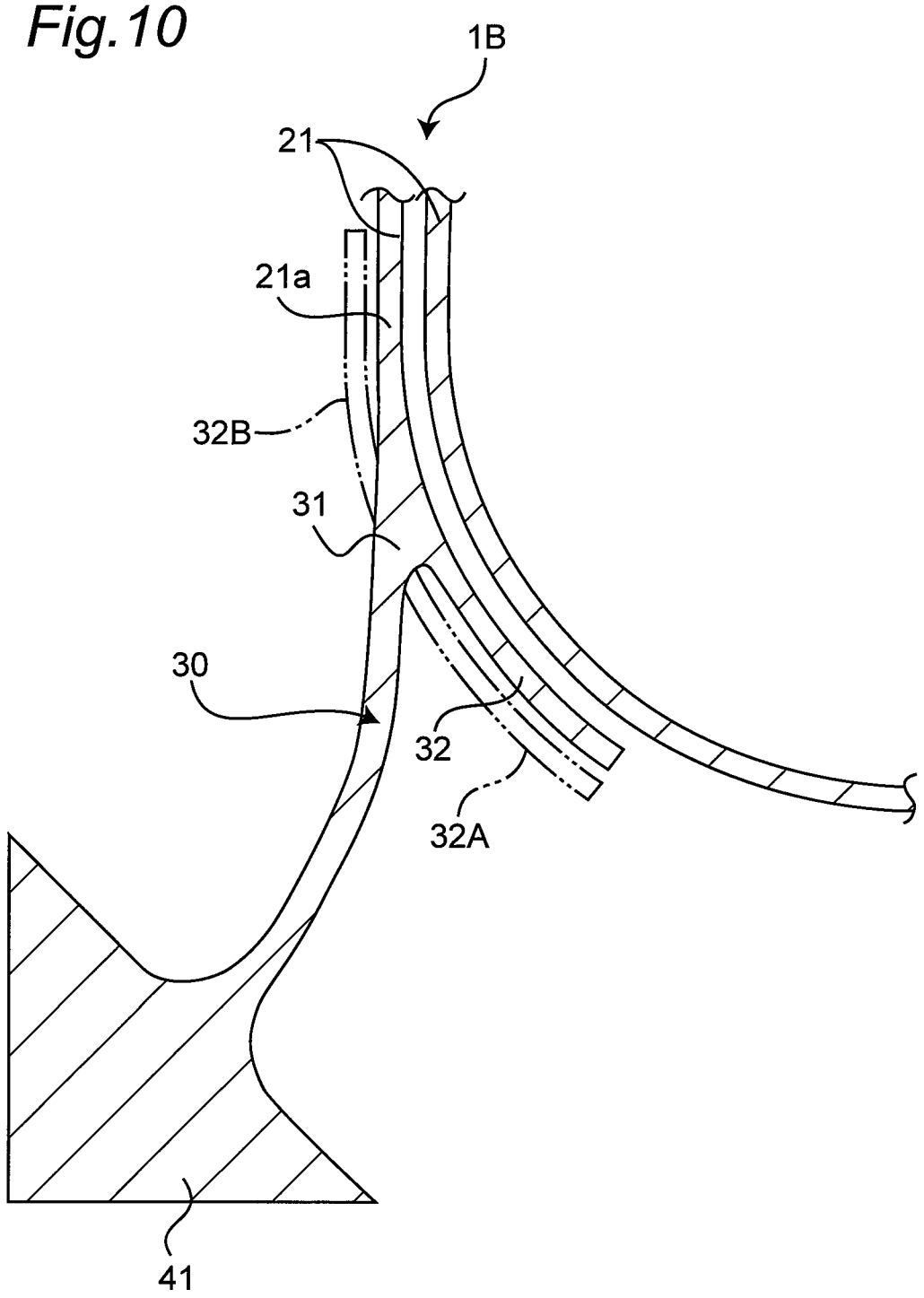
FIG. 10 is an enlarged plane view of a third embodiment of the coil component of the present disclosure.

FIG. 10 is an enlarged plane view of a third embodiment of the coil component of the present disclosure. The third embodiment is different from the first embodiment in the number of branch conductors. This different configuration will hereinafter be described. The other constituent elements are configured as in the first embodiment and denoted by the same reference numerals as the first embodiment and will not be described.

As shown in FIG. 10, in a coil component 1B of the third embodiment, the branch conductor 32 is one of multiple branch conductors. In the coil component 1B, in addition to the branch conductor 32 of the first embodiment, at least one of a first branch conductor 32A and a second branch conductor 32B is disposed.

The first and second branch conductors 32A, 32B are disposed at the connecting portion 31 of the outer-circumferential lead-out conductor 30. The first branch conductor 32A extends outside the branch conductor 32 along the winding direction of the first coil conductor layer 21. The second branch conductor 32B extends outside the first coil conductor layer 21 along a direction opposite to the winding direction of the first coil conductor layer 21.

Therefore, since the multiple branch conductors 32, 32A, 32B exist, the characteristic of frequency of the coil component 1B can be changed or adjusted in a wider range. The number of the branch conductors may be two or may be four or more.

The present disclosure is not limited to the embodiments described above and may be changed in design without departing from the spirit of the present disclosure. For example, respective feature points of the first to third embodiments may variously be combined.

Although the branch conductor is disposed on the first coil conductor layer in the embodiments, the branch conductor may be disposed on at least one of the first coil conductor layer and the second coil conductor layer.

Although the number of the coil conductor layers is two in the embodiments, the number of the coil conductor layers may be one or may be three or more, and at least one coil conductor layer may be provided with the branch conductor.

Although the branch conductor is disposed at one of the outer-circumferential lead-out conductor and the inner-circumferential lead-out conductor in the embodiments, the branch conductors may be disposed at both the outer-circumferential lead-out conductor and the inner-circumferential lead-out conductor. Comparing FIGS. 6A, 6B and FIGS. 9A, 9B, a change in frequency characteristic per wiring length is larger (i.e., the effect is larger) in the case of branching from the outer-circumferential lead-out conductor than the case of branching from the inner-circumferential lead-out conductor.

Although the first coil conductor layer and the second coil conductor layer constitute respective different inductors in the embodiments, the first coil conductor layer and the second coil conductor layer may be connected to form the same inductor. In this case, the number of the external electrodes is two (two terminals). The coil component is used as an impedance matching coil (matching coil) of a high-frequency circuit, for example.

In the embodiments, the coil component may be used also for a tuning circuit, a filter circuit, and a rectifying/smoothing circuit, for example.

In the embodiments, a change or an adjustment is made to the frequency characteristic of the Scc21, or particularly, the frequency at which the attenuation value peaks; however, the present disclosure is not limited thereto. For example, a change or an adjustment may be made to a magnitude and a peak shape (narrower band, broader band) of the attenuation value of Scc21. Moreover, for example, the frequency characteristics of other S-parameters may be changed or adjusted. Furthermore, for example, the present disclosure is not limited to the frequency characteristic, and other characteristics may be changed or adjusted.

What is claimed is:

1. A coil component comprising:

a coil conductor layer wound on a plane;

an outer-circumferential lead-out conductor led out on the same plane as the coil conductor layer from an outer-circumferential end of the coil conductor layer;

an inner-circumferential lead-out conductor led out on the same plane as the coil conductor layer from an inner-circumferential end of the coil conductor layer;

a first external electrode electrically connected to the outer-circumferential lead-out conductor;

a second external electrode electrically connected to the inner-circumferential lead-out conductor; and a branch conductor disposed to branch from at least one of the outer-circumferential lead-out conductor and the inner-circumferential lead-out conductor in a winding direction of the coil conductor layer to an end unattached to the coil conductor layer, the first external electrode, and the second external electrode, and extending on the same plane as the coil conductor layer, wherein the coil conductor layer is wound in an insulating layer, and wherein the insulating layer is nonmagnetic.

2. The coil component according to claim 1, wherein a line width of the branch conductor and a line width of the coil conductor layer are the same.

3. The coil component according to claim 2, wherein:

the coil component has another coil conductor layer laminated on one of the upper and lower sides of the coil conductor layer and wound on a plane, and the branch conductor extends to overlap the other coil conductor layer when viewed in a lamination direction.

4. The coil component according to claim 2, wherein the branch conductor is one of a plurality of branch conductors.

5. The coil component according to claim 1, wherein:

the coil component has another coil conductor layer laminated on one of the upper and lower sides of the coil conductor layer and wound on a plane, and the branch conductor extends to overlap the other coil conductor layer when viewed in a lamination direction.

6. The coil component according to claim 5, wherein the branch conductor is disposed to branch from the outer-circumferential lead-out conductor.

7. The coil component according to claim 6, wherein:

the coil conductor layer and the other coil conductor layer constitute a common mode choke coil, and a proportion of the length of the branch conductor to the length of the coil conductor layer is from 5% to 18%.

8. The coil component according to claim 7, wherein the branch conductor is one of a plurality of branch conductors.

9. The coil component according to claim 5, wherein the branch conductor is one of a plurality of branch conductors.

10. The coil component according to claim 6, wherein the branch conductor is one of a plurality of branch conductors.

11. The coil component according to claim 1, wherein the branch conductor is one of a plurality of branch conductors.

12. The coil component according to claim 1, wherein the coil conductor layer has an aspect ratio of from 1 to 2.5.

13. The coil component according to claim 1, wherein the coil conductor layer has a thickness of from 5 μm to 15 μm.

14. The coil component according to claim 1, wherein the insulating layer comprises a plurality of laminated insulating layers, and wherein the coil component further comprises an element body having the plurality of laminated insulating layers.

15. The coil component according to claim 14, further comprising magnetic substrates sandwiching the element body.

16. The coil component according to claim 1, wherein:

the magnetic substrates have a quadrangular shape when viewed in the lamination direction, and the first external electrode and the second external electrode are disposed on two respective opposite sides of the quadrangular shape.

17. A method of changing a characteristic of frequency of the coil component according to claim 1, wherein the characteristic of frequency of the coil component is changed by changing the length of the branch conductor.

* * * * *